US007104065B2

(12) United States Patent
Benz et al.

(10) Patent No.: US 7,104,065 B2
(45) Date of Patent: Sep. 12, 2006

(54) DAMPING ARRANGEMENT FOR REDUCING COMBUSTION-CHAMBER PULSATION IN A GAS TURBINE SYSTEM

(75) Inventors: Urs Benz, Gipf-Oberfrick (CH); Jaan Hellat, Ruetihof (CH); Franz Joos, Hamburg (DE)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 10/488,595

(22) PCT Filed: Aug. 28, 2002

(86) PCT No.: PCT/IB02/03492

§ 371 (c)(1),
(2), (4) Date: Aug. 6, 2004

(87) PCT Pub. No.: WO03/023281

PCT Pub. Date: Mar. 20, 2003

(65) Prior Publication Data

US 2004/0248053 A1 Dec. 9, 2004

(30) Foreign Application Priority Data

Sep. 7, 2001 (CH) ..... 1663/01

(51) Int. Cl.
*F02C 7/24* (2006.01)

(52) U.S. Cl. ..... 60/725; 60/752

(58) Field of Classification Search ..... 60/752–760, 60/725

See application file for complete search history.

(56) References Cited

U.S. PATENT DOCUMENTS 3,705,492 A * 12/1972 Vickers ..... 60/39.511
3,848,697 A 11/1974 Jannot et al. ..... 181/33 HB
4,112,676 A * 9/1978 DeCorso ..... 60/733
4,296,606 A * 10/1981 Reider ..... 60/754
4,297,842 A * 11/1981 Gerhold et al. ..... 60/776
4,429,538 A * 2/1984 Sato et al. ..... 60/748
4,432,207 A * 2/1984 Davis et al. ..... 60/723
4,446,692 A * 5/1984 Adkins ..... 60/39.23
5,024,058 A * 6/1991 Shekleton et al. ..... 60/752
5,735,126 A * 4/1998 Schulte-Werning ..... 60/732
5,737,922 A * 4/1998 Schoenman et al. ..... 60/752
5,758,504 A * 6/1998 Abreu et al. ..... 60/754

(Continued)

FOREIGN PATENT DOCUMENTS

DE 43 16 475 A1 1/1994

(Continued)

OTHER PUBLICATIONS

Search Report from PCT/IB02/03492 (Oct. 20, 2002).

(Continued)

*Primary Examiner*—William H. Rodriguez
(74) *Attorney, Agent, or Firm*—Cermak & Kenealy, LLP; Adam J. Cermak

(57) ABSTRACT

A description is given of a damping arrangement for reducing resonant vibrations in a combustion chamber (1), with a combustion-chamber wall (2), which is of double-walled design and, with an outer wall-surface part (22) and an inner wall-surface part (21) facing the combustion chamber (1), gastightly encloses an intermediate space (3), into which cooling air can be fed for purposes of convective cooling of the combustion-chamber wall (2).

The invention is distinguished by the fact that at least one third wall-surface part (4) is provided, which, with the outer wall-surface part (22), encloses a gastight volume (5), and that the gastight volume (5) is connected gastightly to the combustion chamber (1) by at least one connecting line (6).

13 Claims, 3 Drawing Sheets

U.S. PATENT DOCUMENTS

| | | | | |
|---|---|---|---|---|
| 6,029,455 | A * | 2/2000 | Sandelis | 60/752 |
| 6,098,397 | A * | 8/2000 | Glezer et al. | 60/772 |
| 6,134,877 | A * | 10/2000 | Alkabie | 60/800 |
| 6,341,485 | B1 * | 1/2002 | Liebe | 60/772 |
| 6,494,044 | B1 * | 12/2002 | Bland | 60/772 |
| 6,606,861 | B1 * | 8/2003 | Snyder | 60/752 |
| 6,672,070 | B1 * | 1/2004 | Bland et al. | 60/772 |
| 6,732,528 | B1 * | 5/2004 | Akagi et al. | 60/752 |
| 6,761,031 | B1 * | 7/2004 | Bunker | 60/752 |
| 6,810,673 | B1 * | 11/2004 | Snyder | 60/752 |
| 6,826,913 | B1 * | 12/2004 | Wright | 60/772 |
| 6,837,050 | B1 * | 1/2005 | Mandai et al. | 60/725 |
| 2003/0010014 | A1 * | 1/2003 | Bland et al. | 60/39.37 |
| 2003/0182942 | A1 * | 10/2003 | Gerendas | 60/752 |
| 2003/0233831 | A1 * | 12/2003 | Suenaga et al. | 60/725 |
| 2004/0261419 | A1 * | 12/2004 | McCaffrey et al. | 60/796 |
| 2005/0000226 | A1 * | 1/2005 | McCaffrey et al. | 60/796 |
| 2005/0022530 | A1 * | 2/2005 | Belsom et al. | 60/752 |
| 2005/0022531 | A1 * | 2/2005 | Burd | 60/752 |
| 2005/0044857 | A1 * | 3/2005 | Glezer et al. | 60/772 |

FOREIGN PATENT DOCUMENTS

| | | |
|---|---|---|
| DE | 196 40 980 A1 | 4/1998 |
| EP | 0 576 717 A1 | 1/1994 |
| EP | 0 669 500 B1 | 9/2000 |
| WO | 93/10401 | 5/1993 |
| WO | 03/02381 A1 | 3/2003 |

OTHER PUBLICATIONS

Search Report from CH 2001 1663/01 (Dec. 6, 2001).

* cited by examiner

DAMPING ARRANGEMENT FOR REDUCING COMBUSTION-CHAMBER PULSATION IN A GAS TURBINE SYSTEM

This is a U.S. national stage patent application filed under 35 U.S.C. § 371 of International application number PCT/IB02/03492, filed 28 Aug. 2002, which claims priority to Swiss application number 2001 1663/01, filed 7 Sep. 2001, the entireties of both of which are incorporated by reference herein.

BACKGROUND OF THE INVENTION

1. Field of the Invention

The invention relates to a damping arrangement for reducing resonant vibrations in a combustion chamber, with a combustion-chamber wall which is of double-walled design, and, with an outer wall-surface part and an inner wall-surface part facing the combustion chamber, gastightly encloses an intermediate space, into which cooling air can be fed for purposes of convective cooling of the combustion-chamber wall.

2. Discussion of Background

A combustion chamber with a combustion-chamber wall of double-walled design mentioned above emerges from EP 0 669 500 B1. There is a flow of compressed combustion feed air for cooling purposes through the enclosed intermediate space of the combustion-chamber wall of double-walled design which surrounds the combustion zone, the combustion-chamber wall of double-walled design being cooled by way of convective cooling. Further details of the particular configuration of a combustion chamber of this kind can be found in the abovementioned European patent, to the disclosure of which explicit reference is made at this point.

Combustion chambers constructed in this way are used primarily for the operation of gas turbines but are also used generally in heat-generating systems, e.g. for firing boilers.

Under certain operating conditions, noise in the form of thermal acoustic vibrations occurs in these combustion chambers and may well show highly pronounced resonant phenomena in the frequency range between 20 and 400 Hz. Such vibrations, which are also known as combustion-chamber pulsations, can assume amplitudes and associated pressure fluctuations that subject the combustion chamber itself to severe mechanical loads that may decisively reduce the life of the combustion chamber and, in the worst case, may even lead to destruction of the combustion chamber.

Since the formation of such combustion-chamber pulsations depends on a large number of boundary conditions, it is difficult or impossible to predetermine precisely the occurrence of such pulsations. On the contrary, it is necessary to respond appropriately during the operation of the combustion chamber in cases of resonant vibration increases, by deliberately avoiding combustion-chamber operating points at which high pulsation amplitudes occur, for example. However, it is not always possible to implement such a measure, especially since, when starting up a gas turbine system, for example, a large number of particular operating states have to be traversed in order to be able to reach the corresponding optimum rated operating range for the gas turbine.

On the other hand, measures for the selective damping of resonant combustion-chamber pulsations of this kind by means of devices, e.g. using suitable acoustic damping elements such as Helmholtz dampers or $\lambda/4$ tubes, are known. Acoustic damping elements of this kind generally comprise a bottleneck and a larger volume connected to the bottleneck, which is matched in each case to the frequency to be damped. Especially when selectively damping low frequencies, there is a need for large damping volumes, which cannot be integrated into every combustion chamber for design reasons.

Active countermeasures are also known for selectively combating combustion-chamber pulsations, by means of which anti-sound fields, for example, are coupled into the combustion chamber for the selective suppression or elimination of resonant pressure fluctuations.

All the initially mentioned measures for selectively damping combustion-chamber pulsations are matched individually to the corresponding conditions of the individual combustion chambers and cannot readily be applied to other types of combustion chamber.

The combustion chamber described at the outset with convective cooling within the combustion-chamber wall, which is of double-walled design, has been optimized in light of combustion with low pollutant emissions. With a combustion chamber of this kind, it is furthermore possible to achieve very lean combustion using a relatively high proportion of air.

SUMMARY OF THE INVENTION

Accordingly, one object of the invention is to provide novel damping measures by means of which effective damping of combustion-chamber pulsations forming within a combustion chamber of the type described above is possible without, at the same time, permanently prejudicing those properties of the combustion chamber that have been optimized for combustion. It is especially the object to find damping measures for which the design requirements entail as small a construction as possible so that they can be integrated in a space-saving manner into combustion-chamber systems of the abovementioned type. In particular, this should leave open the option of integrating the combustion chamber into systems in which space is only limited.

According to the invention, a damping arrangement for reducing resonant vibrations in a combustion chamber, with a combustion-chamber wall, which is of double-walled design and, with an outer wall-surface part and an inner wall-surface part facing the combustion chamber, gastightly encloses an intermediate space, into which cooling air can be fed for purposes of convective cooling of the combustion-chamber wall, is constructed in such a way that at least one third wall-surface part is provided, which, with the outer wall-surface part, encloses a gastight volume, and the gastight volume is connected gastightly to the combustion chamber by at least one connecting line.

The third wall-surface part supplements the combustion-chamber wall, which is of double-walled design in any case, at least locally or in sections to form a three-walled wall structure, the volume gastightly enclosed by the outer wall-surface part of the double-walled combustion-chamber wall and the third wall-surface part serving as a resonance or absorber volume, i.e. is constructed in such a way in size and shape that acoustically effective coupling of the resonance or absorber volume—referred to below simply as absorber volume—to the combustion chamber is provided via the connecting line, designed as a connecting tube, between the absorber volume and the combustion chamber, making possible effective damping of combustion-chamber pulsations of a particular frequency forming within the combustion chamber. The particular selection of size and shape applies also to the connecting tube itself, which must have a particular length and a particular cross section to damp a desired frequency.

To couple the absorber volume delimited by the third wall-surface part acoustically to the interior of the combustion chamber, the connecting line designed as a connecting tube projects locally through the intermediate space of the combustion chamber of double-walled design, through which intermediate space there is a flow of cooling air, and is simultaneously cooled in an effective manner by the flow of cooling air around it. This has the advantage that there does not have to be a separate flow of air through the connecting tube for cooling purposes. It is also possible to prevent heating or overheating of the absorber volume on the part of the combustion chamber through the connecting tube, particularly because, as mentioned above, it undergoes effective cooling. If the cooling effect on the connecting tube of the cooling air flowing around the connecting tube is nevertheless not sufficient, a selective flow of cooling air through the connecting tube can supply the cooling effect that is lacking. This supplementary cooling effect can be accomplished either with the cooling air from the intermediate space and/or from outside the combustion chamber, e.g. from the plenum through an opening within the third wall-surface part. A stream of cooling air of this kind, directed through the connecting tube, should have a flow velocity of less than 10 m/s, however.

In a preferred embodiment, a multiplicity of connecting tubes connected to corresponding absorber volumes is provided along the combustion-chamber wall of double-walled design, preferably at those points at which vibration antinodes form within the combustion chamber. Depending on the respective acoustic conditions, the number of such damping arrangements, each comprising the absorber volume and a connecting tube, and their spatial configuration in terms of size and shape fundamentally determines the combustion-chamber pulsations forming within the combustion chamber, which are also termed thermal acoustic vibrations. Fundamentally, the resonant frequency f to be damped can be calculated in the following way as a function of the absorber volume A to be provided:

$$f = \frac{c_0}{2 \cdot \pi} \cdot \sqrt{\frac{A}{V \cdot (L + 2 \cdot \Delta L)}}$$

where $c_0$ is the speed of sound

A is the open surface of the connecting tube

V is the volume per tube on the cold side

L is the bore length of the tube

ΔL is the mouth correction at the tube

The above formula serves only as a rough guide, however, particularly because neither the mouth correction ΔL nor the speed of sound $c_0$ is precisely known under the operating conditions of a combustion chamber. On the contrary, the natural frequency to be defined by the absorber and to be damped must be determined experimentally. The arrangement of a multiplicity of individual damping elements both along the combustion chamber and in the circumferential direction of the combustion chamber must also be matched individually.

It is the aim of a preferred embodiment to simplify such matching measures. In this embodiment, an adjusting means which adjusts the acoustically effective volume in a variable manner within the gastight volume is provided within the absorber volume, e.g. in the form of a ram, which variably reduces or increases the acoustically effective volume. The term "acoustically effective volume" is to be understood as that part of the absorber volume which is freely accessible to the connecting tube. If the adjusting means designed as a ram divides the absorber volume into two spatial zones, i.e. into a spatial zone in front of and a spatial zone behind the ram surface in relation to the connecting tube, the volume component behind the ram surface does not contribute anything to acoustic absorption or damping.

It is also advantageous in this context to make the third wall-surface part delimiting the absorber volume elastic in order to further improve the degree of damping of the arrangement.

The double-walled combustion-chamber wall is composed in a manner known per se of two wall-surface parts, which can both be produced by way of a casting process. For the exact mutual spacing of the two wall-surface parts, the inner wall-surface part provides so-called longitudinal ribs as spacing elements and holding ribs as fixing webs, by means of which the two wall-surface parts can be connected firmly to one another while maintaining an exact spacing. To avoid further complicating the casting process and indeed to simplify it, the connecting lines designed as connecting tubes are provided along a holding rib, which is provided in any case, enabling the connecting tube and the holding rib to be produced as a one-piece constructional unit together with the inner wall-surface part in a single casting step. This measure furthermore makes the production, by casting, of the inner wall-surface part with an exactly specifiable wall-surface thickness considerably easier, thereby making it possible to achieve large-area wall-surface parts with specifiable constant dimensioning without deviations in thickness.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
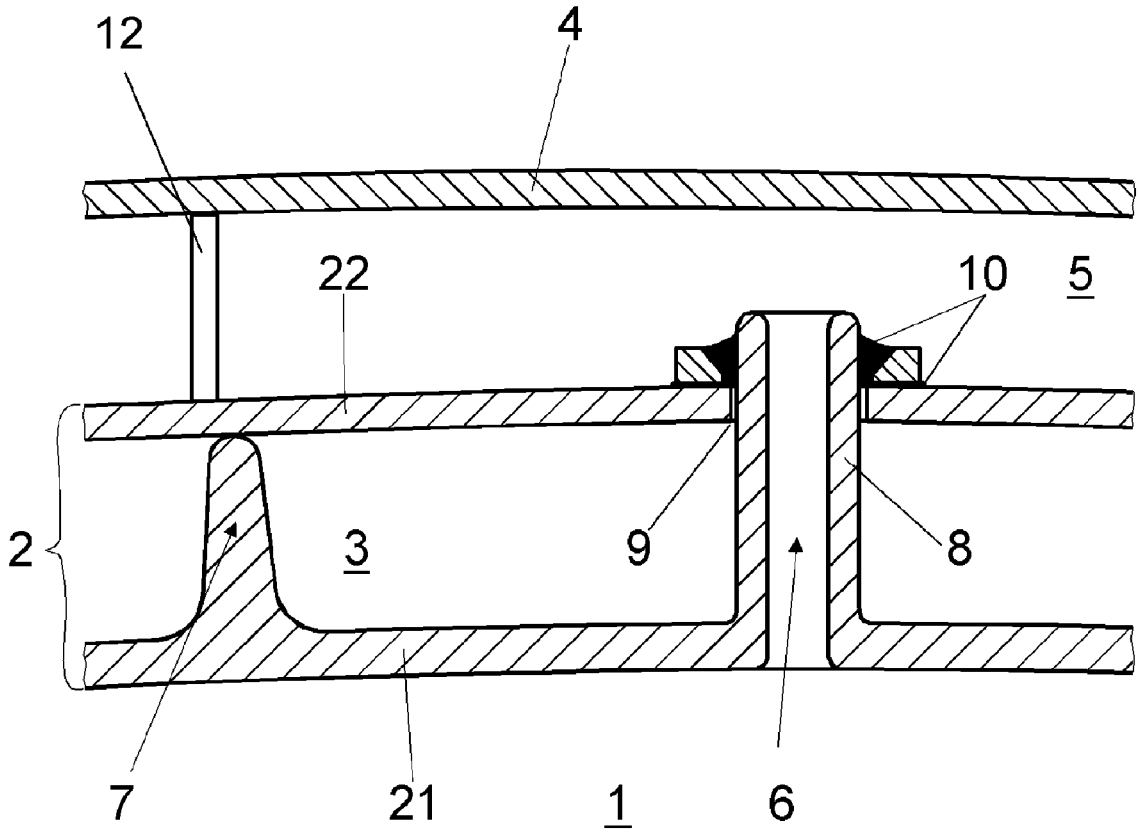
FIG. 1 shows a cross section through a double-walled combustion-chamber wall with an additional resonance absorber, FIGS. 2*a, b, c* show cross sections intended to illustrate an embodiment in a multiplicity of individual absorber units arranged adjacent to one another.

Referring now to the drawings, wherein like reference numerals designate identical or corresponding parts throughout the several wiews, FIG. 1 shows a cross-sectional representation of a damping arrangement for reducing resonant vibrations in a combustion chamber 1 surrounded by a combustion-chamber wall 2, which is of double-walled design and, with an outer wall-surface part 22 and an inner wall-surface part 21, gastightly surrounds an intermediate space 3, into which cooling air can be fed for purposes of convective cooling of the combustion-chamber wall 2, in particular of the inner wall-surface part 21.

Provided on the opposite side of the outer wall-surface part 22 from the combustion chamber 1 is a third wall-surface part 4, which, with the outer wall-surface part 22, encloses a gastight volume, referred to as the resonance or absorber volume 5. Via a connecting line 6 in the form of a connecting tube, the absorber volume 5 is connected directly to the combustion chamber 1 and simultaneously forms an acoustic operative connection between the combustion chamber 1 and the absorber volume 5.

For acoustically effective damping of combustion-chamber pulsations, which occur at certain frequencies within the combustion chamber 1, the geometric variables of the connecting line 6 and of the absorber volume 5 must be adapted individually.

The inner and outer wall-surface part 21 and 22 are manufactured in a manner known per se by a casting technique, the wall-surface part 21 having longitudinal ribs 7, which serve as spacer elements and which ensure an exact predetermined spacing between the outer wall-surface part 22 and the inner wall-surface part 21. At least one spacer element 12 is located between the outer wall-surface part 22 and the third wall-surface part by which the third wall-surface part is directly or indirectly connected to the outer wall-surface part. The inner wall-surface part 21 furthermore usually has holding ribs 8, which are made longer than the longitudinal ribs 7 and, in the assembled condition, project through a corresponding opening 9 within the outer wall-surface part 22 and are firmly connected to the wall-surface part 22 by means of a gastight welded joint 10. The connecting line 6 provided for the acoustic coupling of the absorber volume 5 to the volume of the combustion chamber 1 is advantageously integrally combined with the holding rib 8, which is connected integrally to the inner wall-surface part 21 just like the longitudinal rib 7 and can be produced as part of a single casting process.

Figure 2A:
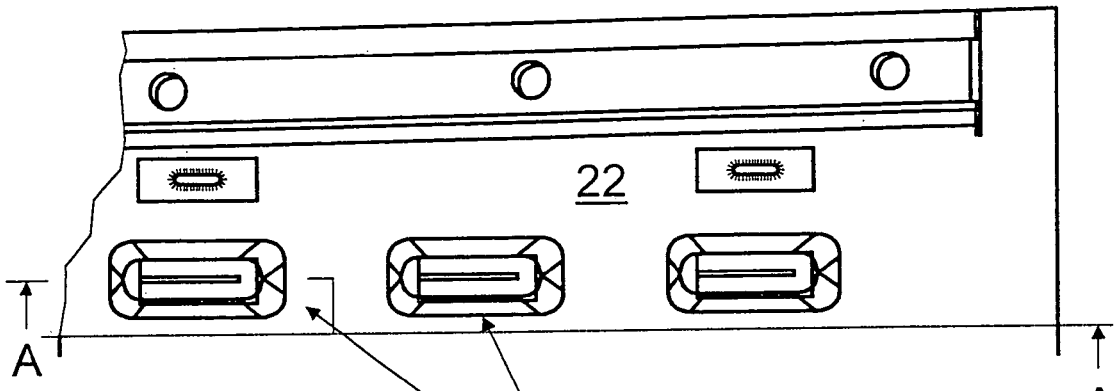
Figure 2B:
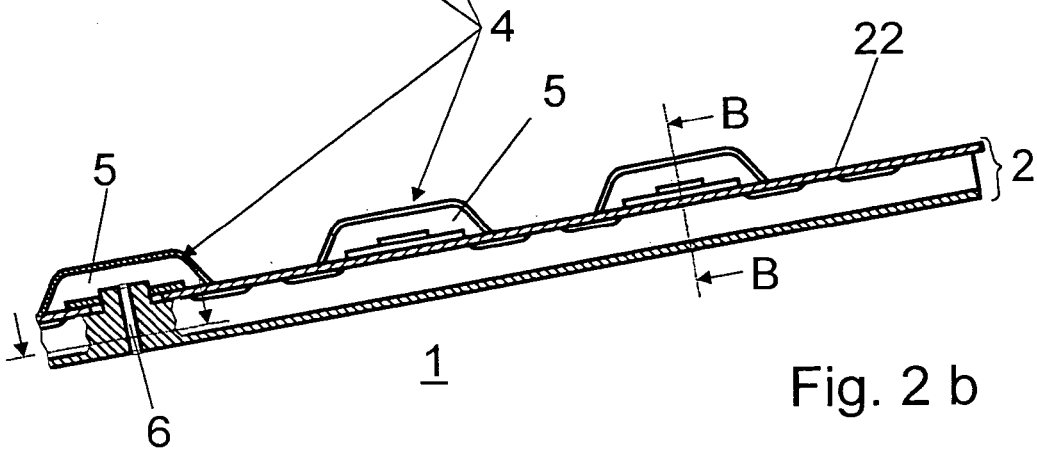
Figure 2C:
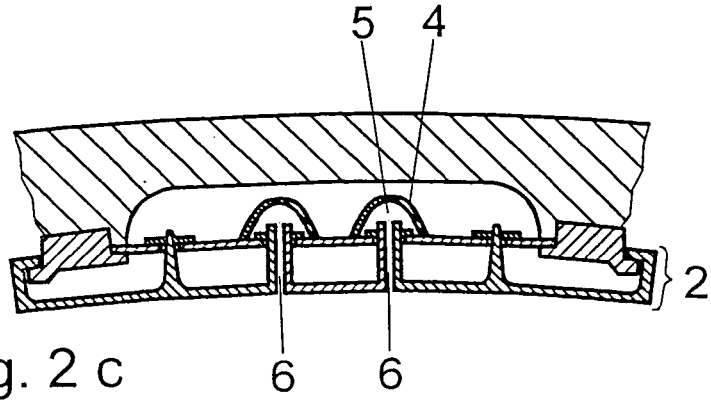

FIGS. 2*a* to *c* show partial views of a preferred implementation of the damping arrangement according to the invention. FIG. 2*a* shows the plan view of the outer wall-surface part 22 of a combustion chamber with locally applied absorber volumes 5, each of which is bounded by a third wall-surface part 4.

FIG. 2*b* shows a sectional representation, along line of section AA in FIG. 2*a*, along the double-walled combustion-chamber wall 2 and the third wall-surface parts 4, each of which is firmly and gastightly connected to the outer wall-surface part 22. Each individual absorber volume 5 covers a connecting line 6, which establishes an acoustically effective connection between the absorber volume 5 and the combustion chamber 1.

FIG. 2*c* shows a sectional representation along line of section BB in FIG. 2*b*, which shows a cross section through the combustion-chamber wall 2. The individual absorber volumes 5 delimited by the third wall-surface part 4, each of which gastightly covers a connecting line 6, are clearly visible.

It is, of course, also possible to cover both immediately adjacent connecting lines 6 by means of a single third wall-surface part 4 only, the effect being that two or more connecting lines 6 project into one and the same absorber volume 5. Such a measure can be selected according to acoustic conditions.

Figure 3:
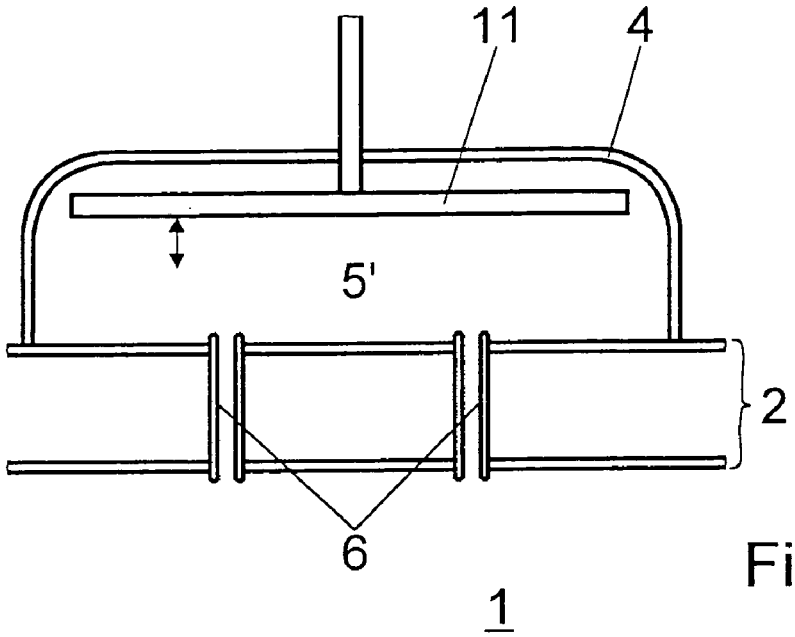
FIG. 3 shows a schematic representation of an absorber volume with a ram arrangement.

In a preferred embodiment in accordance with FIG. 3, an adjusting means 11 of ram-type design, by means of which the acoustically effective volume 5' can be infinitely varied by appropriate linear movement (see double indicating arrow), can be provided within the absorber volume 5 to allow easier individual adaptation of the acoustic damping behavior of the damping arrangement designed in accordance with the invention to the respectively occurring combustion-chamber pulsations. The acoustically effective volume 5' is connected to the combustion chamber 1 by two connecting lines 6 and, in this way, can selectively damp certain combustion-chamber pulsations formed within the combustion chamber 1 according to their frequency.

Figure 4:
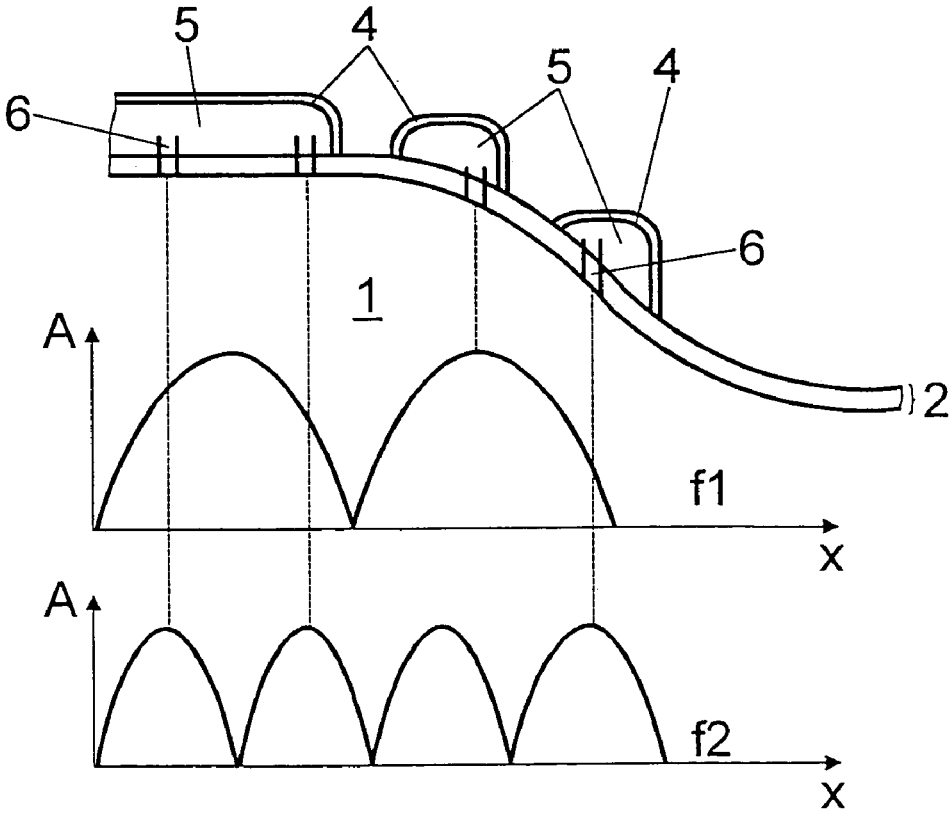
FIG. 4 shows a schematic representation relating to the arrangement of absorber units along a combustion chamber.

To enhance damping performance, a multiplicity of connecting lines are preferably provided along the combustion chamber within the double-walled combustion-chamber wall. The connecting lines are preferably to be provided at precisely those points of the combustion chamber at which vibration antinodes occur. In FIG. 4, the corresponding connecting lines 6 to these are provided within the combustion-chamber wall 2 at those points on the longitudinal axis x of the combustion chamber at which combustion-chamber vibrations of different frequencies f1, f2 have amplitude maxima. Depending on acoustic damping capacity, one or more connecting lines 6 can be combined in a common absorber volume 5.

FIG. 4 also reveals that only one particular frequency can be damped effectively by each absorber volume. To damp two different frequencies f1 and f2, two differently constructed absorber volumes are required. The absorber volumes, which each damp vibrations of one frequency, are preferably arranged axially in series on the combustion-chamber housing. The absorber volumes, each for damping different frequencies, are thus distributed in the circumferential direction of the combustion-chamber housing.

Obviously, numerous modifications and variations of the present invention are possible in light of the above teachings. It is therefore to be understood that within the scope of the appended claims, the invention may be practiced otherwise than as specifically described herein.

LIST OF DESIGNATIONS

1 Combustion chamber
2 Double-walled combustion-chamber wall
21 Inner wall-surface part
22 Outer wall-surface part
3 Cooling-air duct, intermediate space
4 Third wall-surface part
5 Gastight volume, resonance or absorber volume
5' Acoustically effective volume
6 Connecting line, connecting tube
7 Longitudinal rib
8 Holding rib
9 Opening
10 Welded joint
11 Adjusting means
x Longitudinal axis of the combustion chamber
f1, f2 Frequency of the combustion-chamber vibration

What is claimed as new and desired by Letters Patent of the United States is:

1. A damping arrangement for reducing resonant vibrations in a combustion chamber, the damping arrangement comprising:

a double-walled combustion-chamber wall defining a combustion chamber and having an outer wall-surface part and an inner wall-surface part facing the combustion chamber, the outer wall-surface part and the inner wall-surface part gastightly enclosing an intermediate space into which cooling air can be fed for convective cooling of the combustion-chamber wall;

at least one third wall-surface part which cooperates with the outer wall-surface part to enclose a gastight volume;

at least one connecting line;

wherein the gastight volume is connected gastightly to the combustion chamber by the at least one connecting line; and wherein the third wall-surface part is positioned on an opposite side of the outer wall-surface part from the combustion chamber and encloses the gastight volume with said outer wall-surface part.

2. The damping arrangement as claimed in claim 1, further comprising:

at least one spacer element; and wherein the third wall-surface part is connected to the outer wall-surface part directly or indirectly via the at least one spacer element.

3. The damping arrangement as claimed in claim 1, wherein the double-walled combustion-chamber wall includes longitudinal ribs, holding ribs, or both longitudinal ribs and holding ribs, for the exact spacing, mutual fixing, or both exact spacing and mutual fixing, of the inner wall-surface part and the outer wall-surface part; and wherein the at least one connecting line is positioned at the location of the longitudinal, holding, or both, ribs and is constructed as a constructional unit with the longitudinal, holding, or both, ribs.

4. The damping arrangement as claimed in claim 3, wherein the longitudinal ribs, holding ribs, or both the longitudinal ribs and the holding ribs, are integrally connected to the inner wall-surface part by casting.

5. The damping arrangement as claimed in claim 1, wherein each at least one connecting line comprises a connecting tube that projects through the intermediate space and is configured and arrange to have cooling air flowing around the connecting tube.

6. The damping arrangement as claimed in claim 1, wherein the gastight volume comprises a Helmholtz resonator the acoustically effective volume of which is selected based on the acoustic damping of a vibration with a resonant frequency f occurring within the combustion chamber.

7. The damping arrangement as claimed in claim 6, further comprising:

adjusting means for variably adjusting said acoustically effective volume, positioned within the gastight volume.

8. The damping arrangement as claimed in claim 7, wherein the adjusting means comprises a ram movably arranged within the gastight volume.

9. The damping arrangement as claimed in claim 6, wherein the at least one connecting line is arranged at a location relative to the combustion chamber at which an acoustic vibration to be damped has an antinode.

10. The damping arrangement as claimed in claim 1, wherein the third wall-surface part is elastic.

11. The damping arrangement as claimed in claim 10, wherein the at least one connecting line is arranged at a location relative to the combustion chamber at which an acoustic vibration to be damped has an antinode.

12. The damping arrangement as claimed in claim 1, wherein the combustion chamber is integrated into a heat- or energy-generating system.

13. The damping arrangement as claimed in claim 1, wherein the combustion chamber comprises a gas-turbine combustion chamber.

* * * * *